US007938027B2

(12) United States Patent
Topel et al.

(10) Patent No.: US 7,938,027 B2
(45) Date of Patent: May 10, 2011

(54) METHODS AND APPARATUS TO DETERMINE BELT CONDITION IN EXERCISE EQUIPMENT

(75) Inventors: Gregory John Topel, Naperville, IL (US); Gary E. Oglesby, Manhatten, IL (US); Jack Hough, Arlington Heights, IL (US); Emil Golen, Barrington, IL (US); James Skleba, Wheaton, IL (US); Kimberly Halsted, Kenosha, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 12/873,818

(22) Filed: Sep. 1, 2010

(65) Prior Publication Data

US 2010/0326207 A1 Dec. 30, 2010

Related U.S. Application Data

(63) Continuation of application No. 11/776,335, filed on Jul. 11, 2007, now Pat. No. 7,814,804.

(60) Provisional application No. 60/909,224, filed on Mar. 30, 2007.

(51) Int. Cl.
*G01D 1/00* (2006.01)

(52) U.S. Cl. ..... 73/862.53; 73/760

(58) Field of Classification Search ..... 73/760–860, 73/862.53, 379.01–379.09
See application file for complete search history.

(56) References Cited

U.S. PATENT DOCUMENTS 4,095,515 A 6/1978 MacKay
4,186,598 A 2/1980 Okamuro
4,437,563 A 3/1984 Oriol
4,444,065 A 4/1984 Okamuro
4,462,523 A 7/1984 Kerr
4,626,230 A 12/1986 Yasuhara
4,667,336 A 5/1987 Best
4,738,260 A 4/1988 Brown
4,840,372 A 6/1989 Oglesby et al.
4,860,763 A 8/1989 Schminke
4,958,853 A 9/1990 Doty
4,998,725 A 3/1991 Watterson et al.
5,207,108 A 5/1993 Tassic
5,208,633 A 5/1993 Genovese
5,351,530 A 10/1994 Macchiarulo et al.
5,563,392 A 10/1996 Brown et al.
5,747,955 A 5/1998 Rotunda et al.
5,755,018 A 5/1998 Grolik et al.
6,099,439 A * 8/2000 Ryan et al. ..... 482/51
6,162,151 A 12/2000 Tani et al.
6,204,866 B1 3/2001 Yonenaga (Continued)

OTHER PUBLICATIONS

Restriction requirement, issued by the United States Patent and Trademark Office in connection with U.S. Appl. No. 11/776,335, on Sep. 22, 2008, 6 pages.
Non-final office action, issued by the United States Patent and Trademark Office in connection with U.S. Appl. No. 11/776,335, on Nov. 21, 2008, 5 pages.
Final office action, issued by the United States Patent and Trademark Office in connection with U.S. Appl. No. 11/776,335, on Apr. 6, 2009, 7 pages.

(Continued)

*Primary Examiner* — Max Noori
(74) *Attorney, Agent, or Firm* — Hanley, Flight & Zimmerman, LLC

(57) ABSTRACT

Systems, methods and machine readable media related to determining a condition of an exercise machine belt are disclosed. An example system includes a sensor to detect an event related to the exercise machine belt. The example system also includes a counter to selectively change a count based on the event as well as an output device to output a notification associated with the condition of the exercise machine belt based on the count.

35 Claims, 9 Drawing Sheets

U.S. PATENT DOCUMENTS

| | | | | |
|---|---|---|---|---|
| 6,237,752 | B1 | 5/2001 | El-Ibiary | |
| 6,461,278 | B1 | 10/2002 | Troset | |
| 6,506,142 | B2 | 1/2003 | Itoh et al. | |
| 6,569,046 | B1 | 5/2003 | Gregg | |
| 6,622,072 | B2 | 9/2003 | Asumi et al. | |
| 6,684,981 | B2 | 2/2004 | Stucky et al. | |
| 6,831,566 | B1 | 12/2004 | Kusel | |
| 6,886,666 | B2 | 5/2005 | Stucky et al. | |
| 6,943,672 | B2 | 9/2005 | Choi | |
| 6,979,815 | B2 | 12/2005 | Duhamel | |
| 7,022,049 | B2 * | 4/2006 | Ryan et al. | 482/51 |
| 7,115,076 | B2 * | 10/2006 | Oglesby et al. | 482/54 |
| 7,133,630 | B2 | 11/2006 | Sakai | |
| 7,559,879 | B2 * | 7/2009 | Anderson et al. | 482/57 |
| 7,814,804 | B2 * | 10/2010 | Topel et al. | 73/862.53 |
| 2007/0135264 | A1 | 6/2007 | Rosenberg | |

OTHER PUBLICATIONS

Non-final office action, issued by the United States Patent and Trademark Office in connection with U.S. Appl. No. 11/776,335, on Sep. 21, 2009, 8 pages.

Final office action, issued by the United States Patent and Trademark Office in connection with U.S. Appl. No. 11/776,335, on Jan. 13, 2010, 7 pages.

Notice of Panel Decision from Pre-Appeal Brief Review, issued by the United States Patent and Trademark Office in connection with U.S. Appl. No. 11/776,335, on Jul. 14, 2010, 2 pages.

Notice of Allowance, issued by the United States Patent and Trademark Office in connection with U.S. Appl. No. 11/776,335, on Aug. 26, 2010, 4 pages.

Notice of Panel Decision from Pre-Appeal Brief Review, issued by the United States Patent and Trademark Office in connection with U.S. Appl. No. 11/776,335, on Aug. 26, 2009, 2 pages.

* cited by examiner

METHODS AND APPARATUS TO DETERMINE BELT CONDITION IN EXERCISE EQUIPMENT

RELATED APPLICATIONS

This application is a continuation of U.S. patent application Ser. No. 11/776,335, entitled "Methods and Apparatus to Determine Belt Condition in Exercise Equipment," filed on Jul. 11, 2007, which claims priority to U.S. Provisional Patent Application No. 60/909,224, entitled "Methods and Apparatus to Control Workouts on Strength Machines," filed on Mar. 30, 2007, both of which are hereby incorporated by reference in their entireties.

FIELD OF THE DISCLOSURE

This disclosure relates generally to exercise equipment, and, more particularly, to methods and apparatus to determine a belt condition in exercise equipment.

BACKGROUND

Belts used in exercise equipment such as, for example, treadmills, have a typical useful life, after which the belt may fail or cause the exercise machine not to perform satisfactorily. Fitness facility managers can use information about the performance of their treadmills (or other exercise machines that may use a belt) to determine if it is necessary to replace the belts and/or the decks of the treadmills. Fitness facilities typically replace the belt and/or deck of a treadmill after an obvious failure in the exercise machine has occurred.

Belt disintegration, folding over, chunking out, etc. are typical indicators that can prompt replacement of a treadmill belt. However, such indicators often become apparent long after the belt should have been replaced. Replacement of a belt generally leaves the related exercise equipment inoperable during the servicing period, which may include waiting for an ordered belt and/or deck to arrive, waiting for a serviceperson to install a belt and/or deck, etc. Another issue with worn belts is that users can experience reduced performance on an exercise machine with a worn belt, which may cause the users to use another machine. However, users do not always inform the fitness facility of this type of problem. As a result, a worn belt may remain on a machine for an extended period of time, resulting in the machine performing less than optimally and decreasing the effectiveness of a user's exercise routine, the user's opinion of the fitness facility, the value provided by the fitness facility, etc.

One known method for determining belt wear includes analyzing a wattage reading from an exercise machine. For example, when a new machine is received at a fitness facility, the fitness facility may test (i.e., characterize) the machine and gather a wattage reading while operating the machine at a certain pace and mechanical load (i.e., user weight). Throughout the life of the machine, the fitness facility may, at any time, perform a diagnostic test to gather subsequent wattage readings. If any subsequent wattage reading is excessive (e.g., significantly greater than the wattage reading obtained when the exercise machine was new), the facility may replace the belt (and possibly the deck) of the exercise machine. The actual value of the wattage that is considered excessive is not a published, standard value, but varies among fitness facilities and also may vary among exercise machines. Further, the wattage value may be influenced by other parameters such as load and line voltage conditions. Additionally, to be useful, the test must be carried out using precisely the same speeds and user weights (i.e., machine load).

DETAILED DESCRIPTION

Figure 1:
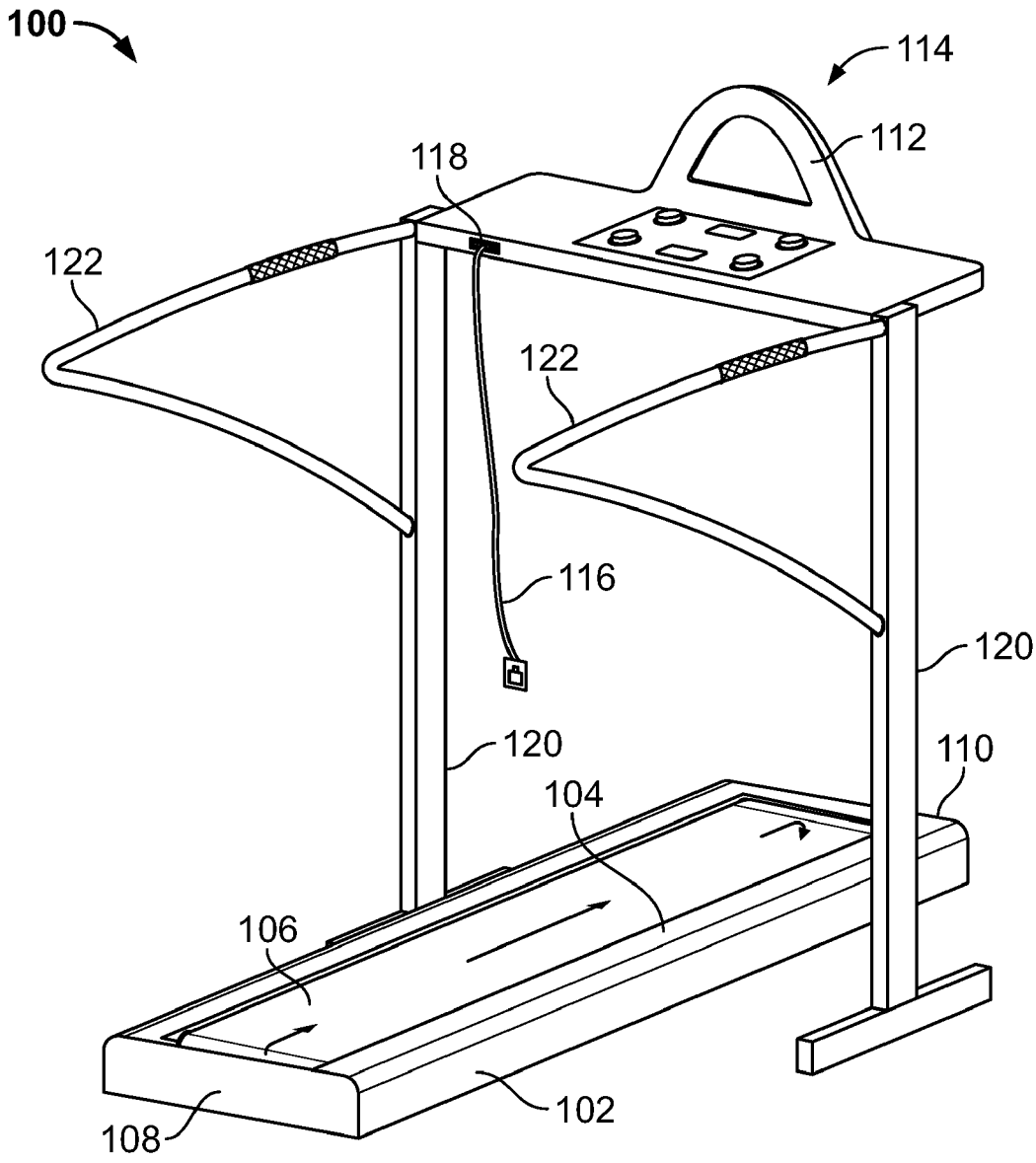
FIG. 1 is an illustration of an example treadmill.

Referring to FIG. 1, an example exercise machine such as, for example, a treadmill 100 is shown. The exercise machine 100 may be any type of exercise machine that supports much of a user's weight or any type of related machine such as, for example, a weight machine, an elliptical trainer machine, a stepper machine, a stationary bicycle, etc. The example exercise machine 100 includes a base 102 that houses a moving platform or deck 104 over which a belt 106, on which a user may walk, jog, and/or run, moves. The base 102 includes a pivot end 108 and an incline end 110, which may be raised and/or lowered to various heights based on user settings and/or programmed training routines. In the illustrated example, the speed of the moving platform 104 and the height of the incline end 110 are controlled by a control unit 112 having a user interface 114. The example control unit 112 may also monitor a safety strap 116 that attaches to the user and/or the user's clothing, and which causes the moving platform 104 to stop if the strap 116 is pulled away or disengaged from a mounting slot 118.

The example exercise machine 100 also includes vertical rails 120 mounted to the base 102 that support the control unit 112 and the user interface 114 components. Additionally, the vertical rails 120 provide support for arms 122 that extend generally perpendicular from the vertical rails 120 and which are generally parallel with the base unit 102. The arms 122 allow the user to support himself/herself while walking, jogging, and/or running on the moving belt 106 and deck 104.

In operation, a user may manually set the speed and/or the incline of the example exercise machine 100. The control unit 112 may store one or more training routines in a memory and/or the control unit 112 may include an input/output (I/O) port to send/receive training routines from various sources including, but not limited to, a network connected to a computer, a computer operated by a personal trainer, and/or the Internet. The I/O port may send/receive training routines and/or user information, such as user age, weight, body mass, etc., via a wired and/or wireless interface. The training routines may automatically adjust operating parameters of the exercise machine 100 (and/or any other type of exercise apparatus) during the user's workout, such as increasing/decreasing speed and/or increasing/decreasing the incline of the incline end 110. As the routine executes, the operating parameters may adjust automatically according to predetermined settings, and/or settings based on the user's weight, age, body fat percentage, height, and/or target heart rate.

As described above, belts and decks used in machinery and in particular, in exercise equipment, have a limited useful life. After a certain period of time, mileage, amount of use, etc. the belt 106 of the exercise machine 100 becomes worn and may begin to function below expectations and/or may fail. One indication that the belt 106 is nearing the end of its useful life is that a slowdown occurs. A slowdown occurs when an exercise machine is unable to reach a speed selected by a user or programmed in a selected training routine, as described above, after a certain amount of time (e.g., 60-70 seconds), i.e., there is an increase in the amount of time until a selected speed is reached. The amount of time required to reach a target speed may vary across machines, users, fitness facilities, etc. A slowdown error also may be referred to as a "cannot attain target speed" (CATS) error. After a certain number of slowdowns occur on a particular exercise machine, the owner of the exercise machine or an employee, serviceman, etc. of a fitness facility or club in which the exercise machine is located may be notified that the belt 106 of the exercise machine 100 may be in need of replacement or repair. The manner in which notification is provided to the appropriate personnel is described in greater detail below.

Although the following describes example apparatus and systems including, among other components, software and/or firmware executed on hardware, it should be noted that such systems are merely illustrative and should not be considered as limiting. For example, it is contemplated that any or all of these hardware, software, and firmware components could be embodied exclusively in hardware, exclusively in software or in any combination of hardware and software. Accordingly, while the following describes example apparatus and systems, persons of ordinary skill in the art will readily appreciate that these examples provided are not the only way to implement such apparatus and systems.

Figure 2:
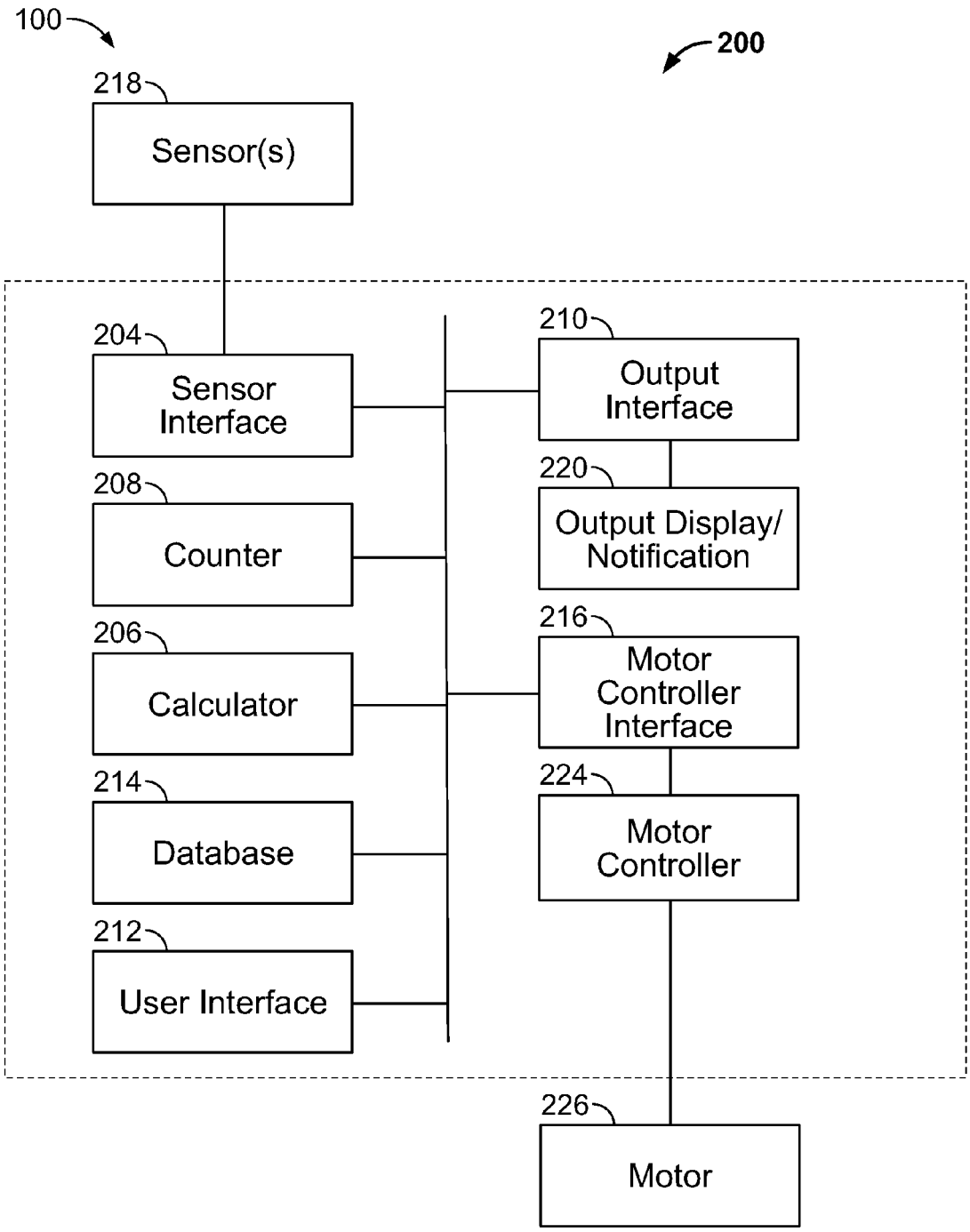
FIG. 2 is a block diagram of a portion of an example exercise machine that uses the example belt condition indicator system and methods described herein.

Now turning to FIG. 2, a portion of the example exercise machine 100 is shown. The example exercise machine 100 includes an example belt wear or belt condition indicator system 200 and related methods described herein. The structures shown in FIG. 2 may be implemented using any desired combination of hardware and/or software. For example, one or more integrated circuits, discrete semiconductor components, or passive electronic components may be used. Additionally or alternatively, some or all, or parts thereof, of the structures of FIG. 2 may be implemented using instructions, code, or other software and/or firmware, etc. stored on a computer-readable medium that, when executed by, for example, a processor system (e.g., the processor system 310 of FIG. 3), perform at least some of the methods disclosed herein. Of course, the structures of FIG. 2 are shown and described below by way of example, and any portion or portions thereof may be changed or rearranged to produce results similar or identical to those disclosed herein.

The belt condition indicator system 200 may be implemented as part of the control unit 112 and may be used to determine a condition of the belt 106 and/or deck 104 such as, for example, when it is likely that the belt 106 and/or deck 104 in the example exercise machine 100 is worn, when a layer of wax on the belt 106 and/or deck 104 has diminished, or when the belt 106 and/or deck otherwise need replacement, maintenance or other attention. As described in greater detail below, the belt condition indicator system 200 may provide appropriate notifications to prompt an owner of the exercise machine 100, an employee of a fitness club that owns or leases the exercise machine 100, or other persons or personnel (e.g., service personnel) to investigate the condition of the belt 106 and/or deck 104. As shown in FIG. 2, the belt condition indicator system 200 includes several communicatively coupled components including a sensor interface 204, a calculator 206, a counter 208, an output interface 210, a user interface 212, and a database 214, which may be stored in a memory such as, for example, a read only memory (RAM), random access memory (ROM), any other type of memory, or any combination thereof, and a motor controller interface 216. These components are discussed in greater detail below.

Furthermore, as shown in FIG. 2, the sensor interface 204 is communicatively coupled to at least one sensor 218 but may, in some examples, be coupled to a plurality of sensors 218. The sensors 218 may be used to gather data such as, for example, a mileage of the belt 106, a user's weight, a user's speed, a time associated with attaining a particular speed, a wattage, a current, a voltage, etc. Data may also be entered via the user interface 212. Data related to these parameters or values may be stored in the database 214. Furthermore, this data may be used by the counter 208 and/or the calculator 206 to determine if various events have occurred such as, for example, that the belt 106 has traveled more than a threshold mileage, that the belt 106 has traveled more than an incremental mileage beyond the threshold mileage, that a slowdown occurred when the user was exercising below a lower speed threshold, that a slowdown occurred when the user was exercising above an upper speed threshold, that a slowdown occurred when the user was exercising between the lower and upper speed thresholds and the user's weight per speed was above or below a maximum user weight per speed, that a wattage is above a wattage threshold, and/or other similar events or combination of events. The slowdowns may be detected by a comparison of one or more of the user's speed with a terminal or target speed, a change in the user's speed, an amount of time needed to reach the target speed, or a change in the amount of time needed to reach the target speed.

Based on the occurrence of one or more of the events, the belt condition indicator system 200 may output a notification of the condition of the belt 106 to the output display or notification device 220 via the output interface 210. In addition, the belt condition indicator system 200 may also communicate a message to the motor controller 224 via the motor controller interface 216. The message may be, for example, to limit the current supplied to the motor 226 based on the occurrence of one or more of the events, which may control the speed of the belt 106 of the exercise machine 100.

Figure 3:
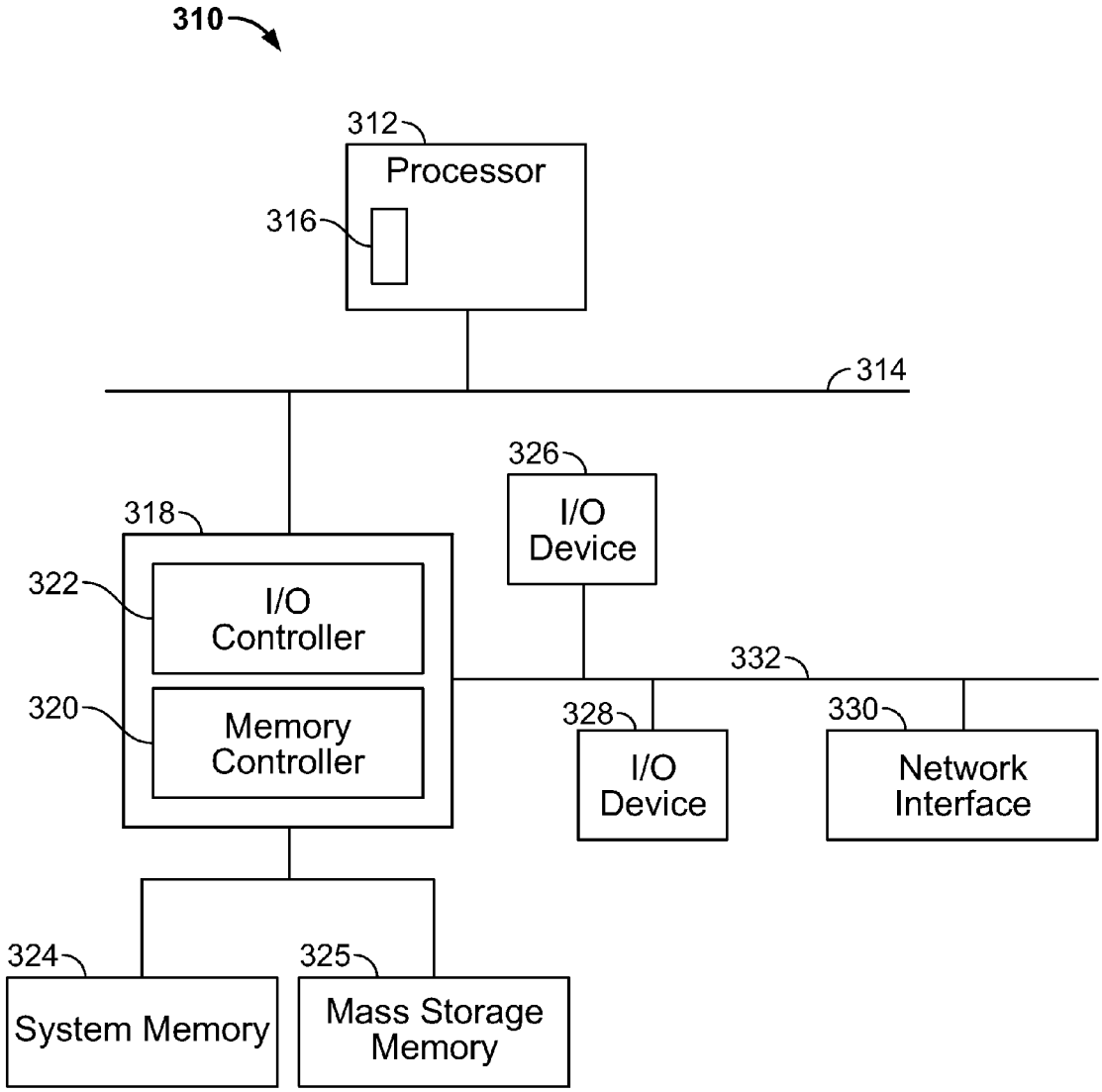
FIG. 3 is a block diagram of an example processor system that may be used to implement the example methods and systems described herein.

FIG. 3 is a block diagram of an example processor system that may be used to implement the systems and methods described herein. As shown in FIG. 3, the processor system 310 includes a processor 312 that is coupled to an interconnection bus 314. The processor 312 includes a register set or register space 316, which is depicted in FIG. 3 as being entirely on-chip, but which could alternatively be located entirely or partially off-chip and directly coupled to the processor 312 via dedicated electrical connections and/or via the interconnection bus 314. The processor 312 may be any suitable processor, processing unit or microprocessor. Although not shown in FIG. 3, the system 310 may be a multi-processor system and, thus, may include one or more additional processors that are identical or similar to the processor 312 and that are communicatively coupled to the interconnection bus 314.

The processor 312 of FIG. 3 is coupled to a chipset 318, which includes a memory controller 320 and an input/output (I/O) controller 322. As is well known, a chipset typically provides I/O and memory management functions as well as a plurality of general purpose and/or special purpose registers, timers, etc. that are accessible or used by one or more processors coupled to the chipset 318. The memory controller 320 performs functions that enable the processor 312 (or processors if there are multiple processors) to access a system memory 324 and a mass storage memory 325.

The system memory 324 may include any desired type of volatile and/or non-volatile memory such as, for example, static random access memory (SRAM), dynamic random access memory (DRAM), flash memory, read-only memory (ROM), etc. The mass storage memory 325 may include any desired type of mass storage device including hard disk drives, optical drives, tape storage devices, etc.

The I/O controller 322 performs functions that enable the processor 312 to communicate with peripheral input/output (I/O) devices 326 and 328 and a network interface 330 via an I/O bus 332. The I/O devices 326 and 328 may be any desired type of I/O device such as, for example, a keyboard, a video display or monitor, a mouse, etc. The network interface 330 may be, for example, an Ethernet device, an asynchronous transfer mode (ATM) device, an 302.11 device, a DSL modem, a cable modem, a cellular modem, etc. that enables the processor system 310 to communicate with another processor system.

While the memory controller 320 and the I/O controller 322 are depicted in FIG. 3 as separate functional blocks within the chipset 318, the functions performed by these blocks may be integrated within a single semiconductor circuit or may be implemented using two or more separate integrated circuits.

Figure 4:
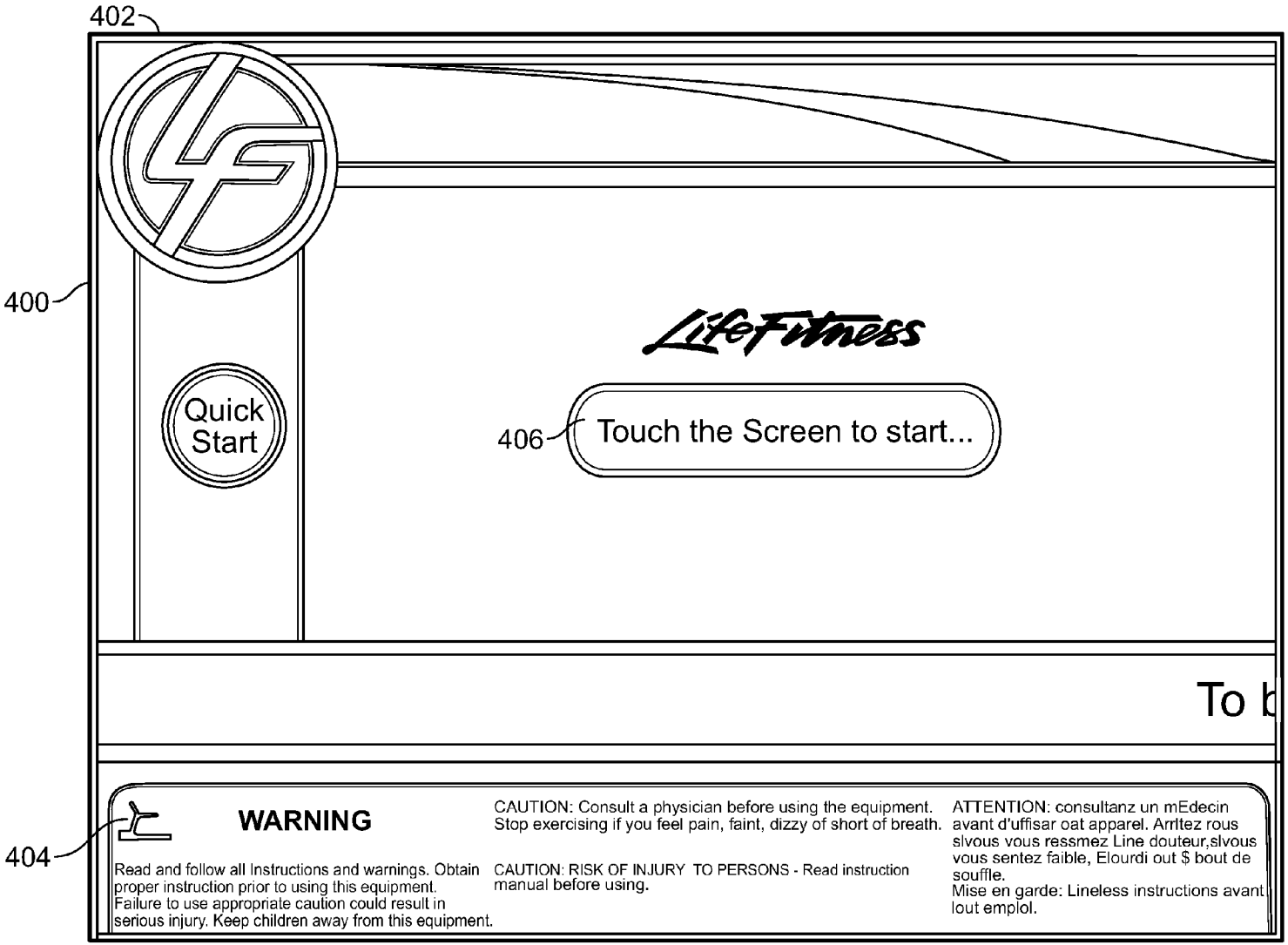
FIGS. 4 and 5 are example displays of the example exercise machine of FIG. 2.

FIG. 4 shows an example display panel 400 of the exercise machine 100. The example the display panel 400 may be provided by a liquid crystal display (LCD) and includes touch screen functionality. However, any type of display may be used. FIG. 4 shows a main display 402 that the exercise machine 100 may generate when the exercise machine 100 is initially powered on or between uses. The main display 402 may provide an external belt condition indicator or notification 404 that indicates, for example, that the belt 106 and/or deck 104 of the exercise machine 100 should be investigated for a condition such as, for example, wear. The generation of belt condition indicator or notification 404 is discussed in greater detail below. In the illustrated example, the belt condition indicator notification 404 is a light or lighted area that appears in the shape of a treadmill. However, any other shape, color, and/or type of light (e.g., blinking) may be used. The main display 402 also includes a notice 406 that indicates, for example, "Touch the Screen to start," which a user can touch to proceed. The user may be the owner of the exercise machine 100, an employee, patron, service person, or any other person associated with a fitness club that owns or leases the exercise machine 100.

Upon touching the notice 406, the user is guided through various other displays and menu options. If the user is a patron at a fitness facility or the owner of the exercise machine 100 who uses the exercise machine 100 for personal use, the user most likely would select from any of the plurality of exercise program buttons appearing on one or more of the subsequent displays. A club owner or other maintenance personnel would likely navigate the subsequent maintenance or management displays or menus.

Figure 5:
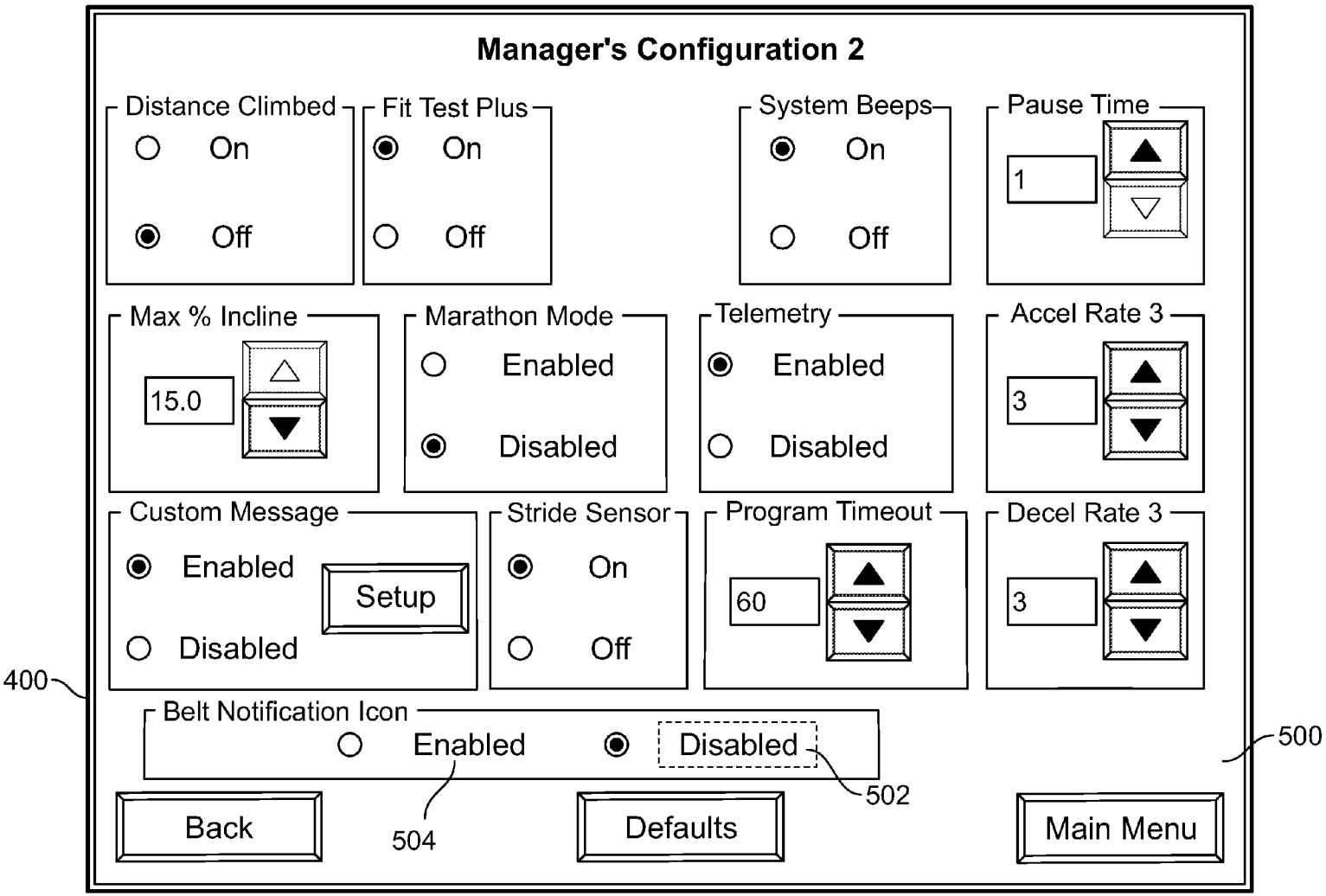

FIG. 5 shows an example maintenance or management menu such as, for example, a system set-up or configuration menu display 500 that may be displayed. The example configuration display 500 includes information that indicates whether or not the belt condition indicator system 200 is enabled or disabled to provide external notifications. As shown in the display 500, the notification process, which is described below in connection with FIG. 8, of the belt wear indictor system 200 is disabled because the "Disabled" area 502 of the display 500 has been selected. To enable the notification process of the belt condition indicator system 200, a user touches the display 500 in the "Enabled" area 504, which results in the darkening of the circle associated with the Enabled area 504, thereby indicating that the notification process of the belt condition indicator system 200 has been enabled to perform the methods described below in conjunction with to FIG. 8 (e.g., to issue external notifications based on the occurrence of one or more of the events).

Figure 6:
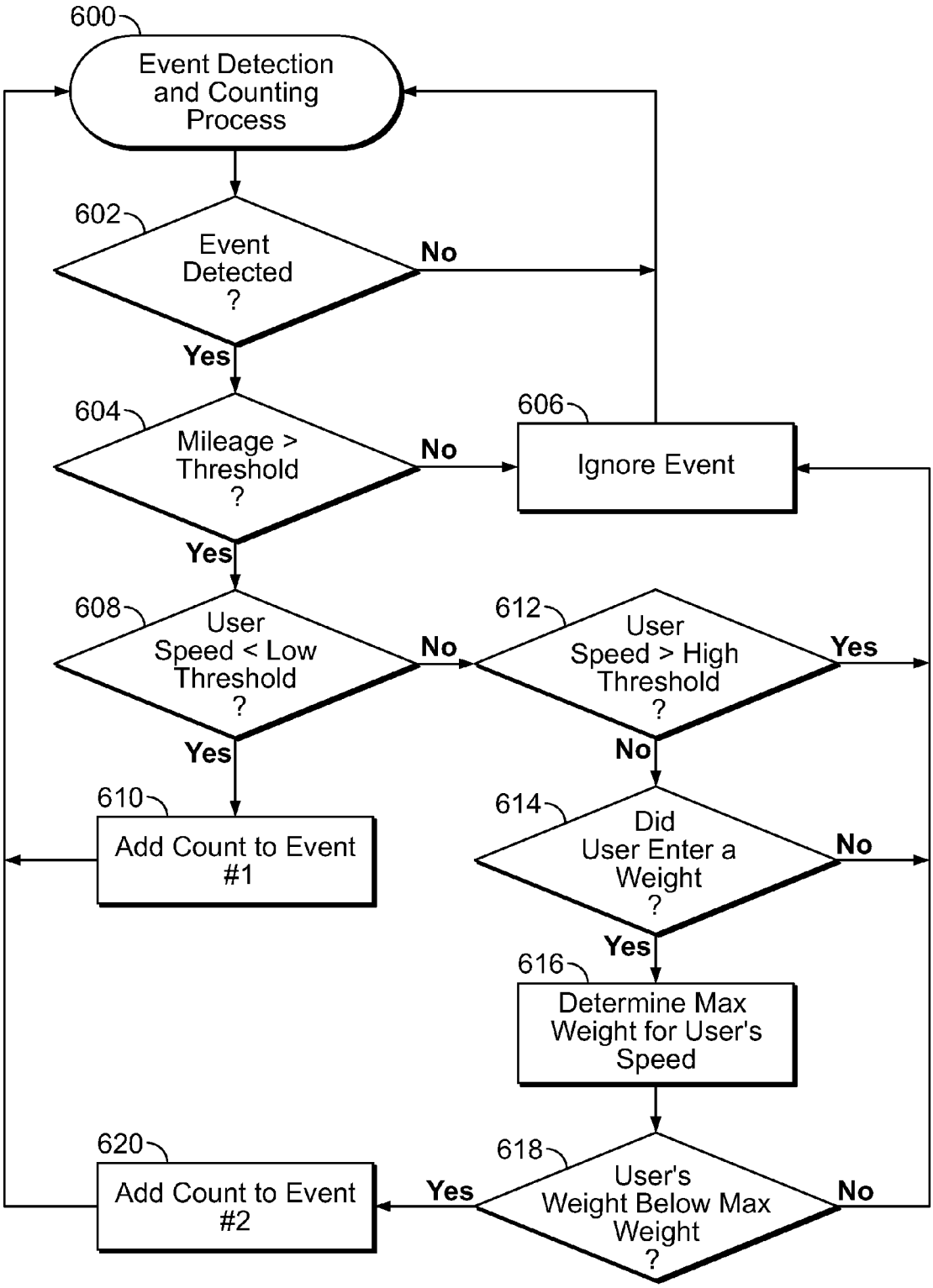
FIG. 6 is a flow diagram of an example event detection and counting process that may be implemented by the example exercise machine and example belt condition indicator system of FIG. 2.
Figure 8:
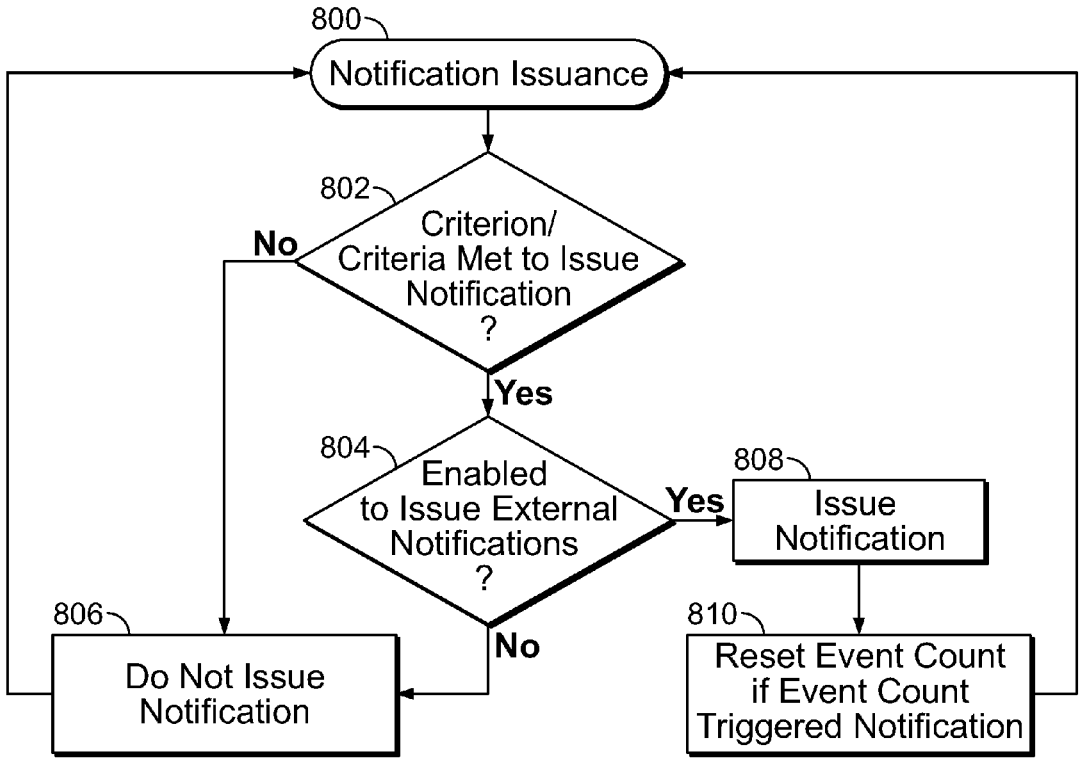
FIG. 8 is a flow diagram of an example process for issuing notifications that may be implemented by the example exercise machine and example belt condition indicator system of FIG. 2.

FIGS. 6 and 8 depict flow diagrams of example processes or methods that may used to sense or detect and count one or more events, such as, for example, slowdowns and issue external notifications via the belt condition indicator system 200. In an example implementation, the operations depicted in the flow diagrams of FIGS. 6 and 8 may be implemented using machine readable instructions that are executed by the example belt condition indicator system 200 of FIG. 2. Some or all of the machine readable instructions may form a program executed by a processor such as the processor 310 shown in FIG. 2. The program may be embodied in software stored on a tangible medium such as a CD-ROM, a floppy disk, a hard drive, a digital versatile disk ("DVD"), or a memory associated with the processor 310 and/or embodied in firmware or dedicated hardware in a well-known manner. For example, the belt condition indicator system 200 and the components included therein (e.g., the calculator 206, the counter 208, etc.) may be implemented using software, hardware, and/or firmware. Further, although the example programs or processes are described with reference to the flow diagrams illustrated in FIGS. 6 and 8, persons of ordinary skill in the art will readily appreciate that many other methods of implementing the belt condition indicator system 200 may alternatively be used. For example, the order of execution of the blocks may be changed, and/or some of the blocks described may be changed, eliminated, or combined.

In general, the example systems, machine readable media and corresponding methods (e.g., FIGS. 6 and 8) described herein may be used to determine a condition of an exercise machine belt, including sensing or detecting when an event associated with the exercise machine belt has occurred, selectively changing a count based on the occurrence of the event, and outputting a notification associated with the condition of the exercise machine belt based on the count. The event in these examples may be a slowdown, or more, generally, an increase in a time to reach a selected speed (e.g., a belt speed, speed associated with a user, etc.). Furthermore, a count is a broad term that may be, for example, a numerical count, an enumeration, a calculation, a symbol, a value, a parameter, a computation, a numbering, an outcome, a poll, a reckoning, a result, a sum, a toll, a total, a whole, etc. In addition, the count may be selectively changed based on one or more parameters, values, counts, etc. As mentioned above, the parameters, values, counts, etc. may be based upon one or more of an occurrence of an event, an occurrence of a slowdown, a user's speed, a lower user speed threshold, an upper user speed threshold, a mileage associated with the exercise machine belt 106, a lower mileage threshold, an incremental mileage, a user's weight, a user's weight per speed, a maximum weight per speed at which an event is expected to occur, a wattage, a current, etc. These parameters, value, counts, etc. may be combined, separated, used in calculations, or otherwise manipulated during the processes described herein.

FIG. 6 is a flow diagram depicting an example event detection and counting process 600 that may be performed by the belt condition notification system 200 of FIG. 2. The example process 600 initially determines if an event has been detected or sensed (block 602) (e.g., via one or more of the sensors 218 of FIG. 2). For example, the example process 600 may detect a failure of an exercise machine (e.g., the machine 100) to reach a selected or desired speed within a certain or predetermined amount of time (e.g., a slowdown as detected, for example, via the sensors 218 and/or calculator 206 and described above). If an event is detected (block 602), the example process 600 determines if the event is to be counted. For example, as described in greater detail below, in response to certain situations or circumstances, an event (e.g., a slowdown) will not be counted as an indication that something negative (e.g., a problem) has occurred with an exercise machine and/or its belt. More specifically, as detailed below, in certain circumstances an event (e.g., a slowdown) is expected to occur and such an expected occurrence should not reflect adversely on the belt and/or the performance of the exercise machine. Thus, in general, the example process 600 qualifies any detected events (e.g., slowdowns), counts those events that meet certain criteria, and issues a notification when the total number of counted events reaches or exceeds a predetermined threshold value.

When an event is detected (block 602) (e.g., via the sensors 218), the example process 600 determines if the mileage of the belt 106 is greater than a threshold mileage (block 604). For example, the sensors 218 may gather information about the use of the belt 106 and, in conjunction with the calculator 206, determine a total mileage traveled by the belt 106 and store the total mileage in the database 214.

The threshold mileage may be any value set by a manufacturer of the exercise machine, a fitness club, an owner of the exercise machine, etc. In addition, the threshold mileage may be different for different exercise machines. In some examples, the threshold mileage may be for example, 18,000 miles, 27,000 miles, 30,000, or any other mileage amount. If the mileage of the belt 106 is less than or equal to (i.e., is not greater than) the threshold mileage, the event is ignored and, thus, may not be counted (block 606) and the process 600 returns control to block 602. The event (e.g., the slowdown) is ignored because a condition of a belt is not likely to exhibit wear or other problems requiring maintenance or replacement of the belt is not likely to have occurred at a mileage below the threshold mileage.

If the mileage is greater than the threshold at block 604, the process 600 determines if the user's speed is less than a low threshold, i.e., a lower user speed threshold (block 608). The lower user speed threshold may be any value set by a manufacturer of the exercise machine, a fitness club, an owner of the exercise machine, etc. In addition, the lower user speed threshold may be different for different exercise machines. In some examples the lower user speed threshold may be about 4.3 miles per hour. If the process 600 determines that the user's speed is less than the lower user speed threshold (block 608), the event (e.g., slowdown) is counted (block 610). The event may be counted by changing a general or aggregate count and/or by changing a count associated with the particular type of event. For example, the counter 208 (FIG. 2) may add a count to a count for the specific type of event that may be labeled, for example, the "Event #1" count. In the example of FIG. 6, "Event #1" designates slowdowns that occurred at user speeds below the lower user speed threshold. Slowdowns that occur when a user is exercising at a speed less than the lower user speed threshold may all be counted regardless of the user's weight because at a speed below the low threshold, the exercise machine 100 can normally carry the weight of most users without experiencing a slowdown. However, if there is a problem with the belt 106 (e.g., the belt 106 is worn), a slowdown of other event may occur at low speeds such as below the lower user speed threshold.

After the counter 208 changes (e.g., increases) the Event #1 count (block 610), the event detection and counting process 600 returns control to block 602 and awaits the detection of another event (e.g. a slowdown).

If, at block 608, a user's speed is not less than the lower user speed threshold, the example process 600 determines if the user's speed is greater than a high threshold, i.e., an upper user speed threshold (block 612). Like the thresholds mentioned above, the upper user speed threshold may be different for different exercise machines and may be set by a manufacturer of the exercise machine, a fitness club, an owner of the exercise machine, etc. In some examples, the upper user speed threshold may be 13.8 miles per hour. In other examples, there may be no upper user threshold in which case the example process 600 would not make the determination indicated in block 612.

If the process 600 determines that the user's speed (block 612) is greater than the upper user speed threshold (block 612), the event (e.g., the slowdown) is ignored and, thus, not counted (block 606) because, as explained in detail below, the belt 106 of the exercise machine 100 likely may not be able to attain such a high speed within a certain amount of time (e.g., between 60-70 seconds) at any user weight. Thus, the event (e.g., the slowdown) detected at block 602 may be expected under these conditions and may not be indicative a belt problem or condition indicative of belt wear.

On the other hand, if the user's speed is less than or equal to the high threshold at block 612 (e.g., is between the lower user speed threshold and the upper user speed threshold), the process 600 determines if a user weight has been provided (e.g., input by a user via the user input 222 or sensed via the sensor(s) 218) (block 614) and stored, for example, in the database 214. If no user weight has been entered (block 614), then the event is ignored and, thus, not counted (block 606).

If the user did enter a weight or a user weight was otherwise provided (block 614), the process 600 determines (e.g., via the calculator 206) a maximum user weight per speed (block 616), i.e., a maximum weight allowed for the user's speed without expecting an event (e.g., a slowdown) to occur. The example process 600 then determines if the user's weight per speed is below the maximum weight per speed (block 618). If, the user's weight is below the maximum weight for the user's speed, then the event (e.g., the slowdown) is counted (block 620). The event may be counted by changing a general or aggregate count or by changing a count associated with the particular type of event. For example, the counter 208 may increase a count associated with a specific type of event. In the example of FIG. 6, "Event #2" designates events (e.g., slowdowns) that occurred when the user's weight is below the maximum user weight for the speed at which the user is exercising. Events (e.g., slowdowns) that occur when the user's weight is below the maximum user weight for the speed at which the user is exercising are counted because the exercise machine 100 can normally handle that particular weight and speed combination while performing in an acceptable manner. However, if there is a problem with the belt 106 (e.g., the belt 106 is worn), the exercise machine 100 will likely generate an event (e.g., a slowdown). If the user's weight is more than the maximum weight for the user's speed, then the event may not be counted (block 606) because the belt 106 of the exercise machine 100 may not be expected to operate optimally with that particular weight and speed combination, as described in more detail below. If the machine 100 can handle any weight at any speed, then there would be no maximum weight per user speed and, thus, the example process may skip blocks 612, 614, 616, 618 and 620.

After the process 600 adds a count to the Event #2 count (block 620), the event detection and counting process 600 returns control to block 602.

Figure 7:
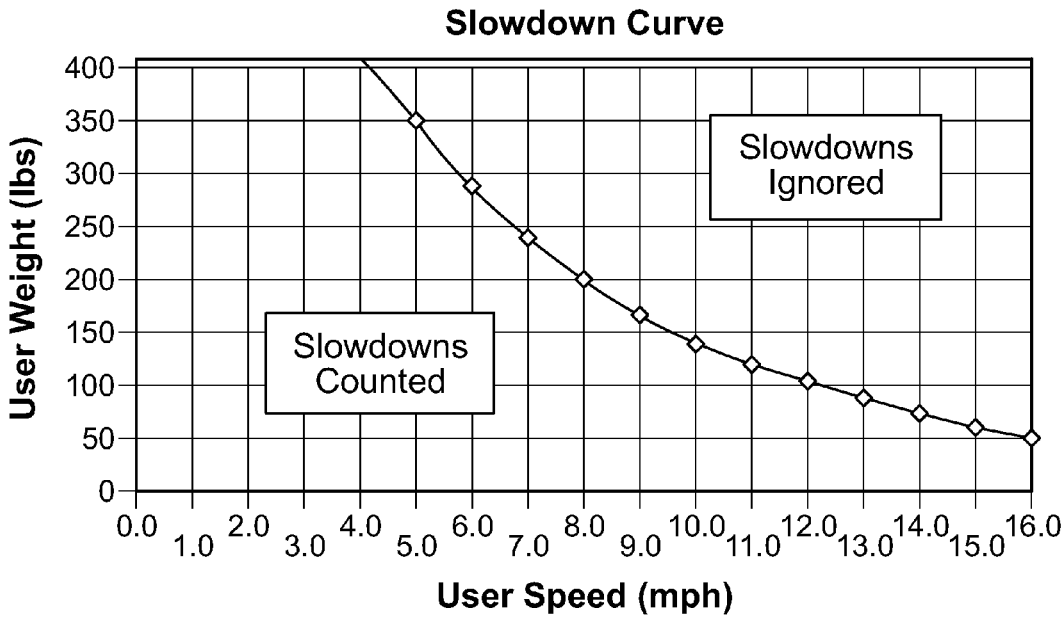
FIG. 7 is an example graph of an example maximum user weight/speed curve.

FIG. 7 is an example graph that includes data that may be used to determine (e.g., at block 616 of FIG. 6) the maximum user weight for a particular speed. The example shown in FIG. 7 uses a motor system with a worn belt at 0.3 coefficient of friction. Events (e.g., slowdowns) that occur on or above the curve are not counted or may otherwise be ignored because it is known that events (e.g., slowdowns) may occur at these weight and speed combinations. Thus, such events may not be indicative that the belt should be inspected, repaired, replaced, etc. In addition, as shown in the curve, the belt can function properly for almost any user weight at speeds at or below the lower user speed threshold (e.g., 4.3 miles per hour). Therefore, all events (e.g., slowdowns) that occur at speeds below this low threshold may be counted because these events are not expected to occur and, thus, may be indicative of a belt condition (e.g., wear) that may require inspection.

Furthermore, at speeds at or above the upper user speed threshold (e.g., 13.8 miles per hour), and user weights greater than or equal to 75 pounds (in this example) all events (e.g., slowdowns) are to be ignored (i.e., not counted). However, the exercise machine is designed for adults weighing more than 75 pounds and, as a result, all events (e.g., slowdowns) that occur over the upper user speed threshold may not be counted (e.g., may be ignored) because these events are expected to occur and, thus, may not indicative of a belt condition associated with wear requiring service or maintenance of the belt.

In the example shown in FIG. 7, the curve represents data for a belt having a 0.3 coefficient of friction. This, coefficient of friction is typically associated with a belt that is about to wear out (i.e., is at the end of its useful service life), has worn out, and/or which should be replaced. While the data of FIG. 7 is associated with a 0.3 coefficient of friction, other coefficients of friction may be used instead, which would alter the example numbers provided herein for the various thresholds. In addition, the example shown in FIG. 7 illustrates when events may be counted or ignored. However, a determination of whether or not events are to be counted may be made using different data and/or graphs.

FIG. 8 is a flow diagram depicting an example notification issuance process 800. The example process 800 determines when an owner, a fitness club employee, other personnel (e.g., service personnel), etc. may be notified regarding the state of the belt 106 of the exercise machine 100. The example process 800 may be performed automatically at any time, or may be prompted by the change of a count (e.g., an addition to or increase of one or both of the Event #1 or Event #2 counts). The process 800 may issue a notification based on the satisfaction of various criteria (block 802). For example, one criterion, as discussed above, may be a belt mileage. In one particular example, if the process 800 (e.g., via the counter 208) determines that the belt (e.g., the belt 106) has reached a threshold mileage and that the belt condition indicator system (e.g., the system 200) has been enabled to provide notifications of belt wear (block 804) then a notification may issue (block 808). After the notification issues (block 808), the process may reset the count (e.g., at least one of the Event #1 or Event #2 counts) (block 810) and control returns to block 802. On the other hand, if the process 800 determines that the criterion/criteria have not been met (block 802) or that the notification system (e.g., the system 200) has not been enabled (block 804), then a notification is not issued (block 806).

The threshold mileage may be any mileage value, including the aforementioned threshold mileage value discussed with respect to FIG. 6 that was used to determine whether an event (e.g., a slowdown) is to be counted. This value may be set by a manufacturer of the exercise machine, an owner of the exercise machine, a fitness club, etc. For example, the threshold mileage value may be set at 27,000 miles, 30,000 miles or any mileage amount. Thus, if, for example, the average speed per workout is between 4.5 miles per hour and 5.0 miles per hour, 5400 to 6000 hours of use of the belt would accumulate before 27,000 miles of use accumulate. With an average annual usage rate of, for example, 2,555 hours per year, it would take between 2.1 and 2.3 years to accumulate 27,000 miles of belt use. Thus, the first notification may not issue for about 2.1 to 2.3 years.

The exercise machine owner or fitness club may set different parameters based on how frequently the belt 106 is to be inspected or replaced based upon costs, experience, or any other standard.

The notification issuance process 800 may also trigger or issue a notification (block 808) based on an incremental mileage reached beyond the threshold mileage (block 802), provided the belt condition indicator system 200 is enabled to issue notifications (block 804). For example, if the threshold mileage is set to 27,000 miles, the owner or fitness club may set the belt condition indicator system 200 to provide further notifications to inspect the belt 106 at multiples of the incremental mileage (e.g., at every 3,000 miles, 5,000 miles, etc.). Similar to the threshold mileage, the incremental mileage may be any figure and may be set by the manufacturer, owner, fitness club employees, etc. In addition, the owner, fitness club employees, etc. may disable this feature to limit the number of notifications that issue.

Another criterion that may be used to determine if a notification is issued (block 802) is the count associated with an event. For example, the notification issuance process 800 may trigger a notification (block 808) after the counter 208 counts a certain number of the Event #1 type events (block 610 of FIG. 6). For example, after certain number of slowdowns have occurred at a user speed below the lower user speed threshold, at any user weight, and the belt condition indicator system 200 is enabled to issue notifications (block 804), the notification issuance process 800 may issue a notification (block 808). In particular, the belt condition indicator system 200 may be set to count every slowdown (as an Event #1 slowdown, for example) that occurs when the user is exercising at less than 4.3 miles per hour. Then, after the certain number (e.g., two) of the Event #1 events are counted (block 802), the notification issuance process 800 may issue a notification (block 808). If the certain number (e.g., two) of the Event #1 events are not counted, then a notification may not issue (block 806), i.e., a notification may not issue for this reason. In addition, if a notification is triggered (block 808) based on the occurrence (and counting) of the certain number of the Event #1 events, the Event #1 event counter may be reset (block 810) manually or automatically after the notification has issued. After the event counter has been reset, another notification may issue after the certain number of events have occurred again.

Similarly, the notification issuance process 800 may trigger a notification (block 808) after the counter 208 counts a certain number of the Event #2 type events (e.g., slowdowns) (block 610 of FIG. 6). For example, after a certain number of slowdowns that occurred at a user speed between the lower user speed threshold and the upper user speed threshold speed at a weight below the maximum weight per speed as calculated during the event detection and counting process 600 and the belt condition indicator system 200 has been enabled to issue notifications (block 804), the notification issuance process 800 may issue an external notification (block 808). For example, the belt condition indicator system 200 may be set to count every slowdown (as an Event #2 slowdown, for example) that occurs when the user is exercising between 4.3 miles per hour and 13.8 miles per hour and the user weighs less than the maximum user weight for that user speed, calculated as indicated above. Then, after, for example, three of the Event #2 events are counted (block 802), the notification issuance process 800 issues a notification (block 808). If the certain number (e.g., three) of the Event #2 events are not counted, then a notification may not issue (block 806). In addition, if a notification is triggered (block 808) based on the occurrence (and counting) of the certain number of the Event #2 events, the Event #2 event counter may be reset (block 810) manually or automatically after the notification has been issued. After the event count has been reset, another notification may issue after the certain number of events have occurred again.

If the belt condition indicator system 200 is not enabled to issue external notifications, the belt condition indicator system 200 continues to count and qualify slowdowns. The information and internal notifications may be stored in the belt condition indicator system 200 and may be accessed as described below at any time.

Though four criteria were discussed above that may be considered in the determination of issuing a notification, any combination or these criteria and/or other criteria (e.g., wattage, current, etc.) may also be considered during the determination of issuing a notification regarding the condition of a belt in an exercise machine.

After a notification has issued and/or on review of diagnostic data regarding the performance of the exercise machine 100 that may be stored in the belt condition indicator system 200, the owner, fitness club employee, service personnel, or other personnel may inspect the exercise machine 100 to determine if the belt 106 needs to be replaced, the deck 104 needs to be turned over, the deck 104 needs to be waxed, and/or whether other steps should be taken to return the exercise machine 100 to satisfactory working order.

Figure 9:
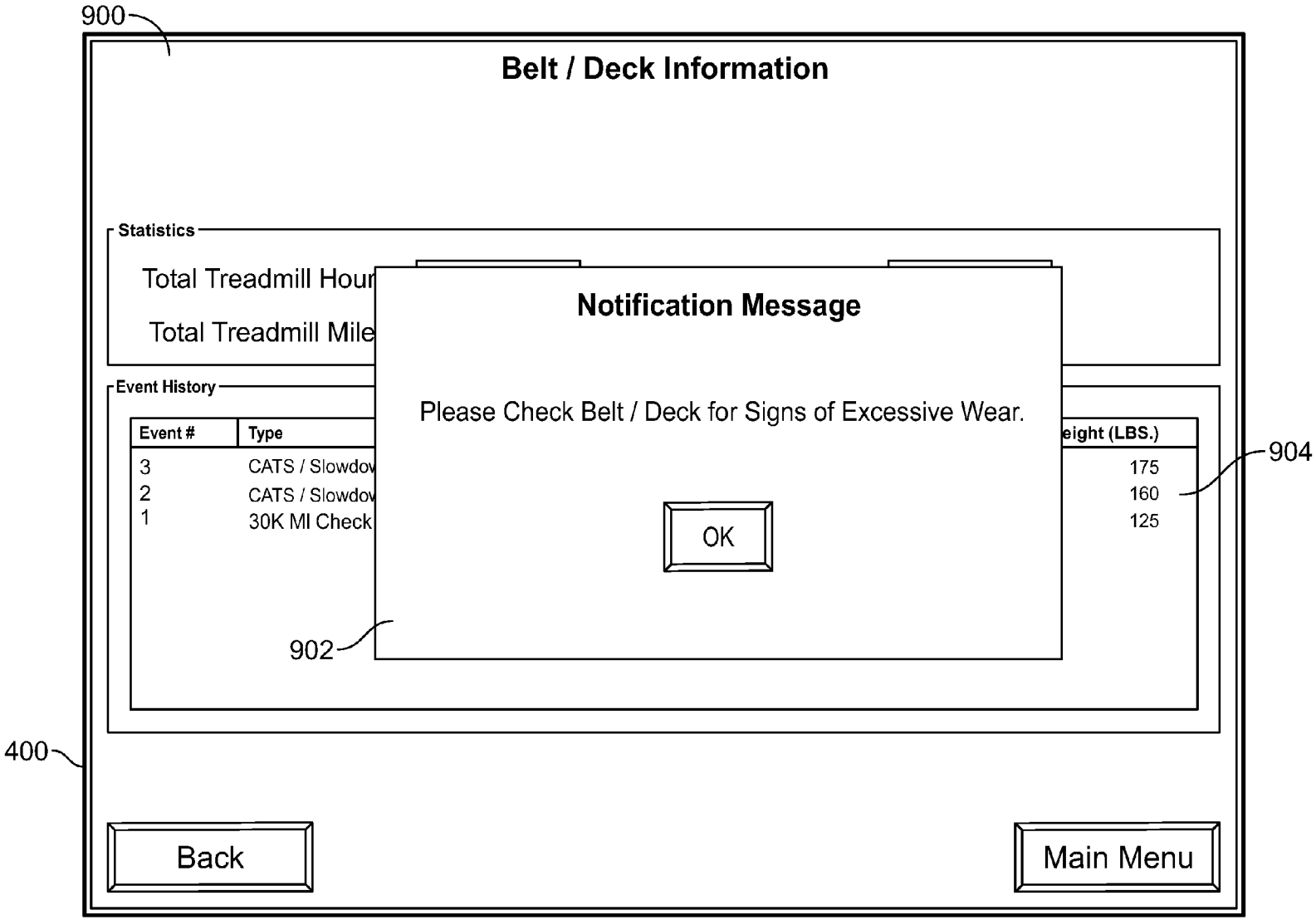
FIGS. 9 and 10 are additional example displays of the example exercise machine of FIG. 2.
Figure 10:
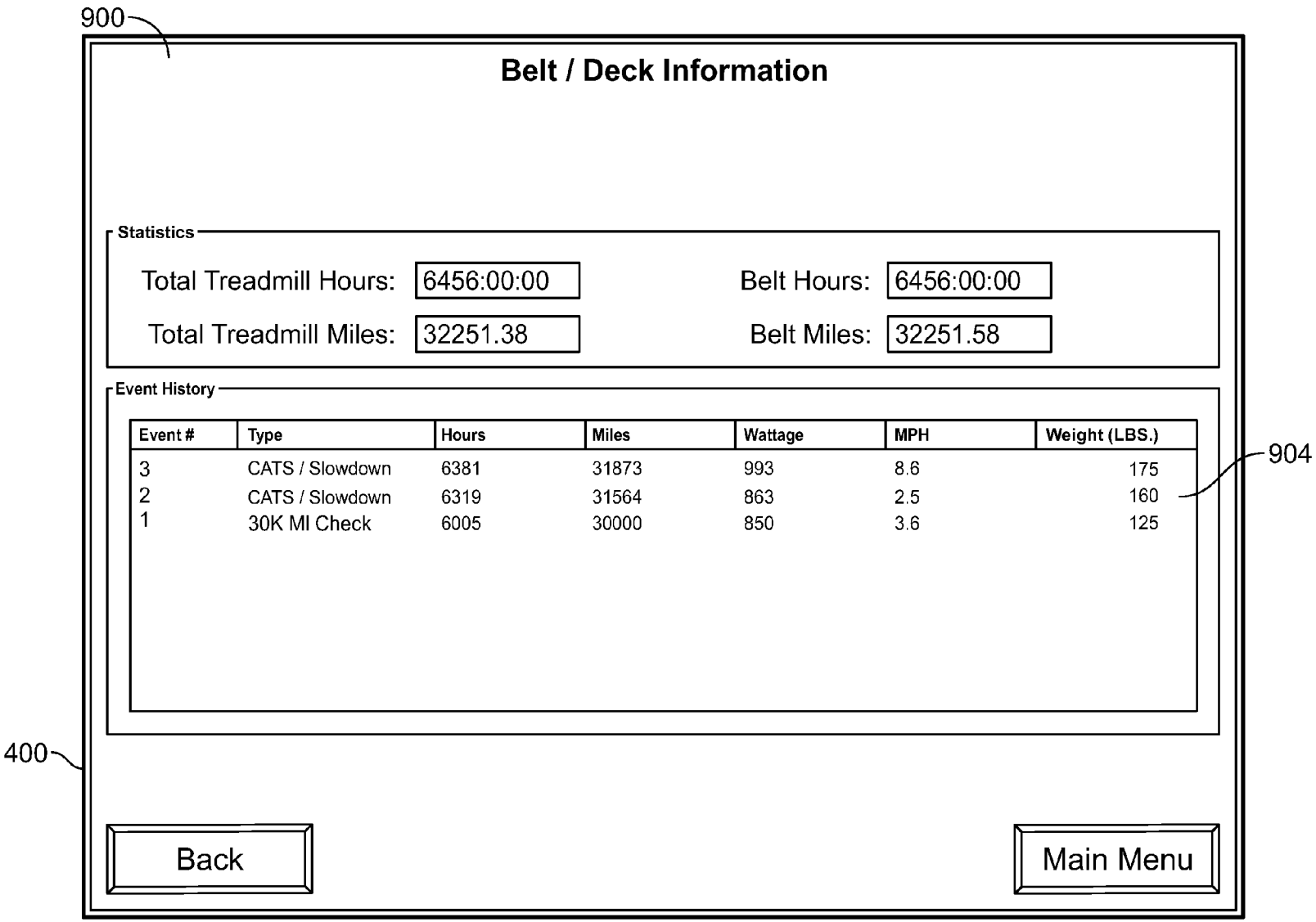

To investigate the notification, a person may navigate through various maintenance and system configuration displays or menus that may be provided by the machine 100. Such displays or menus may include various diagnostic data about the belt 106 and/or the deck 104 as well as other features of the machine 100. An example diagnostics display 900 that may appear on the main display 400 (FIG. 4) is shown in FIGS. 9 and 10 and may be titled, for example, "Belt/Deck Information." The diagnostics display 900 may include an internal notification message 902 (separate from the external notification 404 of FIG. 4), which indicates that the belt 106 should be visually inspected for wear. The internal notification message 902 may appear even when the belt condition indicator system 200 has not been enabled to issue external notifications. If no notification has issued, the diagnostics display 900 may indicate as much. The diagnostics display 900 also may include specific information 904 about the mileage of the belt 106 or the counts associated with Event #1 and Event #2 type events, as well as any other information related to the exercise machine 100, the belt 106, and/or the deck 104 that may also be used to determine if excessive belt wear has occurred. A history of the events is kept in a log, and any or all of the events recorded and displayed on the diagnostics display 900 may be manually cleared (e.g., a person may reset the Event #1 and/or Event #2 counts and/or clear the mileage).

In addition, the external notification 404 may be any sort of visual or audio signal such as, a light or a graphic on the display 400 or elsewhere on the exercise machine 100 to facilitate the ease with which the owner or fitness club employee may be alerted to a potential belt wear problem. Furthermore, the notification may be triggered substantially simultaneously with the incident(s) or event(s) that cause(s) the notification to issue. Thus, the belt condition indicator system 200 provides real-time feedback regarding the performance of the exercise machine 100, which may eliminate or reduce the down time of the exercise machine 100 that is incurred if the belt 106 unexpectedly fails. In other words, such real-time feedback further reduces potential failure of the belt 106 without notice.

Notifications may also be triggered based on wattage. The average wattage is tracked throughout the life of the belt. On a new unit or when a new belt is installed, the processor 310 records a "starting wattage" value and compares that value to a running average wattage value, which is automatically calculated by the calculator 206 and which may be stored in the database 214. The starting wattage value may be based on the average wattage during the first 100 hours of use. This value is compared to the ongoing or running average wattage value and, if a large enough change between the starting wattage and the automatically generated average wattage is detected, a notification may be issued.

The belt condition indicator system 200 may also count faults in the motor controller 224 (FIG. 1). The motor controller 224 may be used to limit the current supplied to the motor 226 to prevent damage to the exercise machine 100 during an event (e.g., a slowdown). If the motor controller 224 faults (at times that may or may not coincide with, for example, a slowdown), the fault may be recorded. After a certain number of faults, a notice may be triggered, similar to the notification issuance process 800 described above.

Furthermore, any or all of the notification features described herein may be disabled. Disabling any feature may occur, for example, by setting the relevant variable to zero. If all configurations are set to zero, a notification may not occur regardless of the occurrence of any of the incidents or events described above. In addition, the above-described examples may have applications beyond exercise equipment.

Although certain example apparatus, methods, and machine readable instructions have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A system to determine a maintenance condition of an exercise machine belt, the system comprising:

a sensor to detect events related to the exercise machine belt;

a counter including:

a processor programmed to selectively change a count based on the events related to the exercise machine belt, and a comparator that instructs the counter not to change the count based on the detection of one event related to the exercise machine belt and the comparator instructs the counter to change the count based on the detection of another event related to the exercise machine belt, and an output device to output a notification associated with the maintenance condition of the exercise machine belt based on the count.

2. A system to determine a maintenance condition of an exercise machine belt as defined in claim 1, wherein one of the events is an increase in a time to reach a selected speed.

3. A system to determine a maintenance condition of an exercise machine belt as defined in claim 1, wherein the counter is to selectively change the count based on one of the events and a user's speed.

4. A system to determine a maintenance condition of an exercise machine belt as defined in claim 3, wherein the user's speed is below a threshold.

5. A system to determine a maintenance condition of an exercise machine belt as defined in claim 1, wherein the counter is to selectively change the count based on one of the events and a mileage associated with the exercise machine belt.

6. A system to determine a maintenance condition of an exercise machine belt as defined in claim 1, wherein the counter is to selectively change the count based on one of the events and a user's weight per speed.

7. A system to determine a maintenance condition of an exercise machine belt as defined in claim 6, wherein the user's weight per speed is below a maximum weight per speed at which one of the events is expected to occur.

8. A system to determine a maintenance condition of an exercise machine belt as defined in claim 1, wherein the notification is at least one of an audio signal or a visual signal.

9. A system to determine a maintenance condition of an exercise machine belt as defined in claim 1, further comprising a log including a history of notifications.

10. A system to determine a maintenance condition of an exercise machine belt as defined in claim 1, further comprising a motor controller to limit current in response to one of the events.

11. A system to determine a maintenance condition of an exercise machine belt as defined in claim 1, further comprising a control unit to communicate information related to at least one of an event, the count, the output, or the maintenance condition of the exercise machine belt over a network.

12. A system to determine a maintenance condition of an exercise machine belt as defined in claim 1, wherein the maintenance condition includes at least one of a worn state of the belt, a diminished state of a layer of wax on the belt or a replacement need of the belt.

13. A system to determine a maintenance condition of an exercise machine belt as defined in claim 1, further comprising a control unit to change an operating mode of the exercise machine based on at least one of an event, the count, the output, or the maintenance condition of the exercise machine belt.

14. A system to determine a maintenance condition of an exercise machine belt as defined in claim 1, wherein one or more event is a slowdown.

15. A system to determine a maintenance condition of an exercise machine belt as defined in claim 1, wherein the one event and the other event are not consecutive.

16. A system to determine a maintenance condition of an exercise machine belt as defined in claim 1, wherein the one event and the other event are successive.

17. A system to determine a maintenance condition of an exercise machine belt as defined in claim 1, wherein the comparator instructs the counter to change a first count based on a first type of event and the comparator instructs the counter to change a second count based on a second type of event.

18. A system to determine a maintenance condition of an exercise machine belt as defined in claim 1, wherein the count is less than the total number of events.

19. A method for determining a maintenance condition of an exercise machine belt, the method comprising:

sensing events associated with the exercise machine belt;

selectively changing a count based on one of the events associated with the exercise machine, wherein selectively changing the count includes not changing the count based on one event associated with the exercise machine and changing the count based on another event associated with the exercise machine; and outputting a notification associated with the maintenance condition of the exercise machine belt based on the count.

20. A method for determining a maintenance condition of an exercise machine belt as defined in claim 19, wherein one of the events is an increase in a time to reach a selected speed.

21. A method for determining a maintenance condition of an exercise machine belt as defined in claim 19, wherein selectively changing the count comprises changing the count based on one of the events and a user's speed.

22. A method for determining a maintenance condition of an exercise machine belt as defined in claim 21, wherein the user's speed is below a threshold.

23. A method for determining a maintenance condition of an exercise machine belt as defined in claim 19, wherein selectively changing the count comprises changing the count based on one of the events and a mileage associated with the exercise machine belt.

24. A method for determining a maintenance condition of an exercise machine belt as defined in claim 1, wherein the notification is at least one of an audio signal or a visual signal.

25. A method for determining a maintenance condition of an exercise machine belt as defined in claim 19, further comprising storing the notification in a log.

26. A method for determining a maintenance condition of an exercise machine belt as defined in claim 19, further comprising using a motor controller to limit current in response to one of the events.

27. A method for determining a maintenance condition of an exercise machine belt as defined in claim 19, further comprising communicating information related to one or more of one or more event, the count, the output, the maintenance condition of the exercise machine belt over a network.

28. A method for determining a maintenance condition of an exercise machine belt as defined in claim 19, wherein the maintenance condition includes at least one of a worn state of the belt, a diminished state of a layer of wax on the belt or a replacement need of the belt.

29. A method for determining a maintenance condition of an exercise machine belt as defined in claim 19, further comprising changing an operating mode of the exercise machine based on one or more of one or more event, the count, the output, the maintenance condition of the exercise machine belt.

30. A system to determine a maintenance condition of an exercise machine belt as defined in claim 1, wherein the comparator instructs the counter to not change the count based on the detection of one event when a belt mileage is less than or equal to a threshold mileage.

31. A system to determine a maintenance condition of an exercise machine belt as defined in claim 1, wherein the comparator instructs the counter to change the count based on the detection of one event when a user's speed is less than a low threshold speed.

32. A system to determine a maintenance condition of an exercise machine belt as defined in claim 1, wherein the comparator instructs the counter to not change the count based on the detection of one event when a user's speed is greater than a high threshold speed.

33. A system to determine a maintenance condition of an exercise machine belt as defined in claim 1, wherein the comparator instructs the counter to not change the count based on the detection of one event when a user weight has not been provided.

34. A system to determine a maintenance condition of an exercise machine belt as defined in claim 1, wherein the comparator instructs the counter to change the count based on the detection of one event when a user's weight per speed is below a threshold maximum weight per speed for a particular user weight and a particular user speed.

35. A system to determine a maintenance condition of an exercise machine belt as defined in claim 17, wherein the first type of event is a slowdown occurring at a user speed below a low speed threshold and the second type of event is a slowdown occurring at a user weight per speed below a maximum user weight per speed for a particular user weight and a particular speed.

* * * * *